US007517290B1

(12) United States Patent
Springer

(10) Patent No.: US 7,517,290 B1
(45) Date of Patent: Apr. 14, 2009

(54) PRACTICE DEVICE FOR SOFTBALL PITCHERS

(76) Inventor: Jeffrey Springer, 668 Big Lick Rd., Oakboro, NC (US) 28129

( * ) Notice: Subject to any disclaimer, the term of this patent is extended or adjusted under 35 U.S.C. 154(b) by 126 days.

(21) Appl. No.: 11/690,077

(22) Filed: Mar. 22, 2007

(51) Int. Cl.
*A63B 69/00* (2006.01)

(52) U.S. Cl. ..... 473/422; 473/451; 473/428

(58) Field of Classification Search ..... 473/422, 473/451, 428, 417, 426–427, 453
See application file for complete search history.

(56) References Cited

U.S. PATENT DOCUMENTS 2,985,452 A * 5/1961 Trippet ..... 473/453
5,322,276 A * 6/1994 Hardison, Jr. ..... 473/417
5,441,255 A * 8/1995 Verbick ..... 473/55
7,217,202 B2 * 5/2007 Troxell ..... 473/451
7,300,365 B2 * 11/2007 Taylor ..... 473/451
2006/0199673 A1 * 9/2006 Littlejohn ..... 473/422

* cited by examiner

*Primary Examiner*—Mitra Aryanpour
(74) *Attorney, Agent, or Firm*—Michael I Kroll

(57) ABSTRACT

A practice device for softball pitchers. The device is designed to help a pitcher develop better throwing mechanics by teaching proper spin, release, and follow through for various breaking pitches. Using the device consistently helps a pitcher improve technique, which would ultimately enhance performance in game situations. The device consists of a tripod stand, having an adjustable boom arm at its top, a wedge shaped frame and bracket with a short post assembly to which a regulation sized softball is attached. The side of the bracket opposite the soft ball features a short, right angled mounting bracket. The vertical portion of the bracket features a hole in its center and thus could be secured to the post on the booms stand filter assembly via a wing nut.

22 Claims, 13 Drawing Sheets

PRACTICE DEVICE FOR SOFTBALL PITCHERS

BACKGROUND OF THE INVENTION

Field of the Invention

The present invention relates generally to baseball practice devices and, more specifically, to a practice device for softball players, specifically pitchers. The device is designed to help a pitcher develop better throwing mechanics by teaching proper spin, release, and follow through for various breaking pitches. Using the device consistently would help a pitcher improve technique, which would ultimately enhance performance in game situations.

The present invention consists of a tripod stand measuring approximately three feet tall, having an adjustable boom arm at its top, a wedge shaped frame and bracket with a short post assembly to which a regulation sized softball is attached. The side of the bracket opposite the soft ball would feature a short, right angled mounting bracket. The vertical portion of the bracket would feature a hole in its center and thus could be secured to the post on the booms stand tilter assembly via a wing nut. The appealing features of the present invention is it's convenience, ease of use, light in weight, portability and ability to improve a pitcher's technique and mechanics.

SUMMARY OF THE PRESENT INVENTION

A primary object of the present invention is to provide a practice device for softball players, specifically pitchers.

Another object of the present invention is to provide a practice device for softball players that is designed to help a pitcher develop better throwing mechanics by teaching proper spin, release, and follow through for various breaking pitches.

Yet another object of the present invention is to provide a practice device for softball that consists of a tripod stand measuring approximately three feet tall, having an adjustable boom arm at its top via a wing nut for the mounting of a wedge shaped frame.

Still yet another object of the present invention is to provide a practice device for softball that consists of a wedge shaped frame and bracket with a short post assembly to which a regulation sized softball is attached.

Another object of the present invention is to provide a practice device for softball that the side of the bracket opposite the soft ball would feature a short, right angled mounting bracket. The vertical portion of the bracket would feature a hole in its center and thus could be secured to the post on the booms stand tilter assembly via a wing nut.

Yet another object of the present invention is to provide a practice device for softball that provides convenience, ease of use, light in weight, portability and ability to improve a pitcher's technique and mechanics.

Additional objects of the present invention will appear as the description proceeds.

The present invention overcomes the shortcomings of the prior art by providing a practice device for softball players, specifically pitchers. The device is designed to help a pitcher develop better throwing mechanics by teaching proper spin, release, and follow through for various breaking pitches. Using the device consistently would help a pitcher improve technique, which would ultimately enhance performance in game situations. The present invention consists of a tripod stand measuring approximately three feet tall, having an adjustable boom arm at its top, a wedge shaped frame and bracket with a short post assembly to which a regulation sized softball is attached. The side of the bracket opposite the soft ball would feature a short, right angled mounting bracket. The vertical portion of the bracket would feature a hole in its center and thus could be secured to the post on the booms stand tilter assembly via a wing nut. The appealing features of the present invention is it's convenience, ease of use, light in weight, portability and ability to improve a pitcher's technique and mechanics.

The foregoing and other objects and advantages will appear from the description to follow. In the description reference is made to the accompanying drawing, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawing, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

DESCRIPTION OF THE REFERENCED NUMERALS

Figure 1:
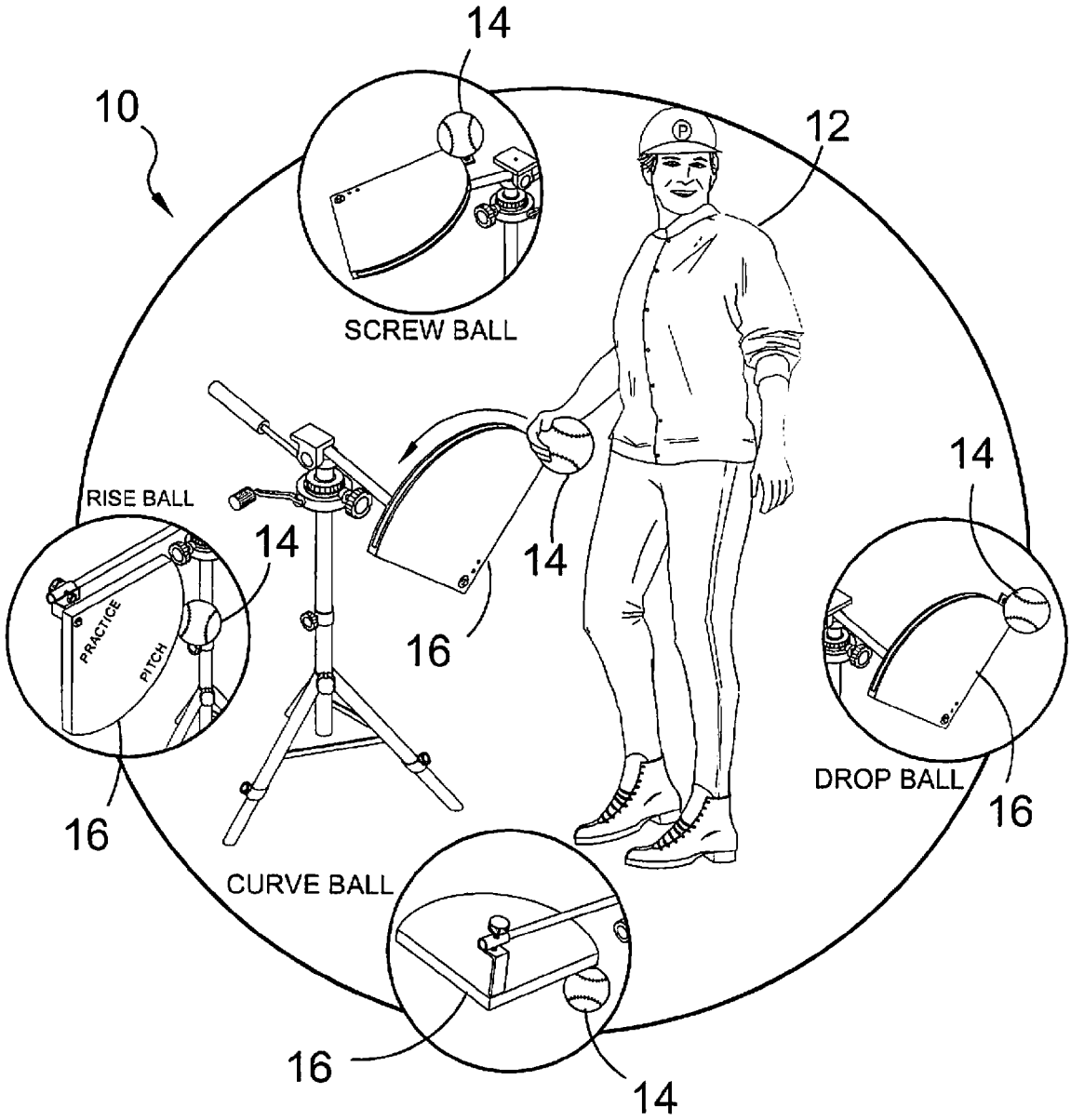
FIG. 1 is an illustrative view of the present invention in use.

Turning now descriptively to the drawings, in which similar reference characters denote similar elements throughout the several views, the figures illustrate the Pitching Practice Device of the present invention. With regard to the reference numerals used, the following numbering is used throughout the various drawing figures.

10 Pitching Practice Device of the present invention

12 user/pitcher

14 softball

16 guide wedge

18 pivoting bracket
20 tripod
22 boom arm assembly
23 boomarm
24 threaded post of 18
25 boom assembly mount
26 adjustable legs of 20
28 height adjustment
30 main shaft of 20
32 boom arm angle tilt handle
34 guide wedge orientation adjustment
36 wedge mounting post
38 mounting bracket
40 wing nut
42 mounting aperture
44 release point
46 threaded aperture of 14
48 attachment point of 18
50 wedge channel

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments, practitioners skilled in the art will recognize numerous other embodiments as well. For definition of the complete scope of the invention, the reader is directed to appended claims.

FIG. 1 is an illustrative view of the present invention 10 in use. The present invention is a practice device for softball players, specifically pitchers 12. Shown is the user 12 grasping a regulation sized softball 14 that is secured to a pivoting bracket that travels within a track defined within a guide wedge 16. The device is designed to help a pitcher 12 develop better throwing mechanics by teaching proper spin, release, and follow through for various breaking pitches. Using the device consistently would help a pitcher 12 improve technique, which would ultimately enhance performance in game situations.

Figure 2:
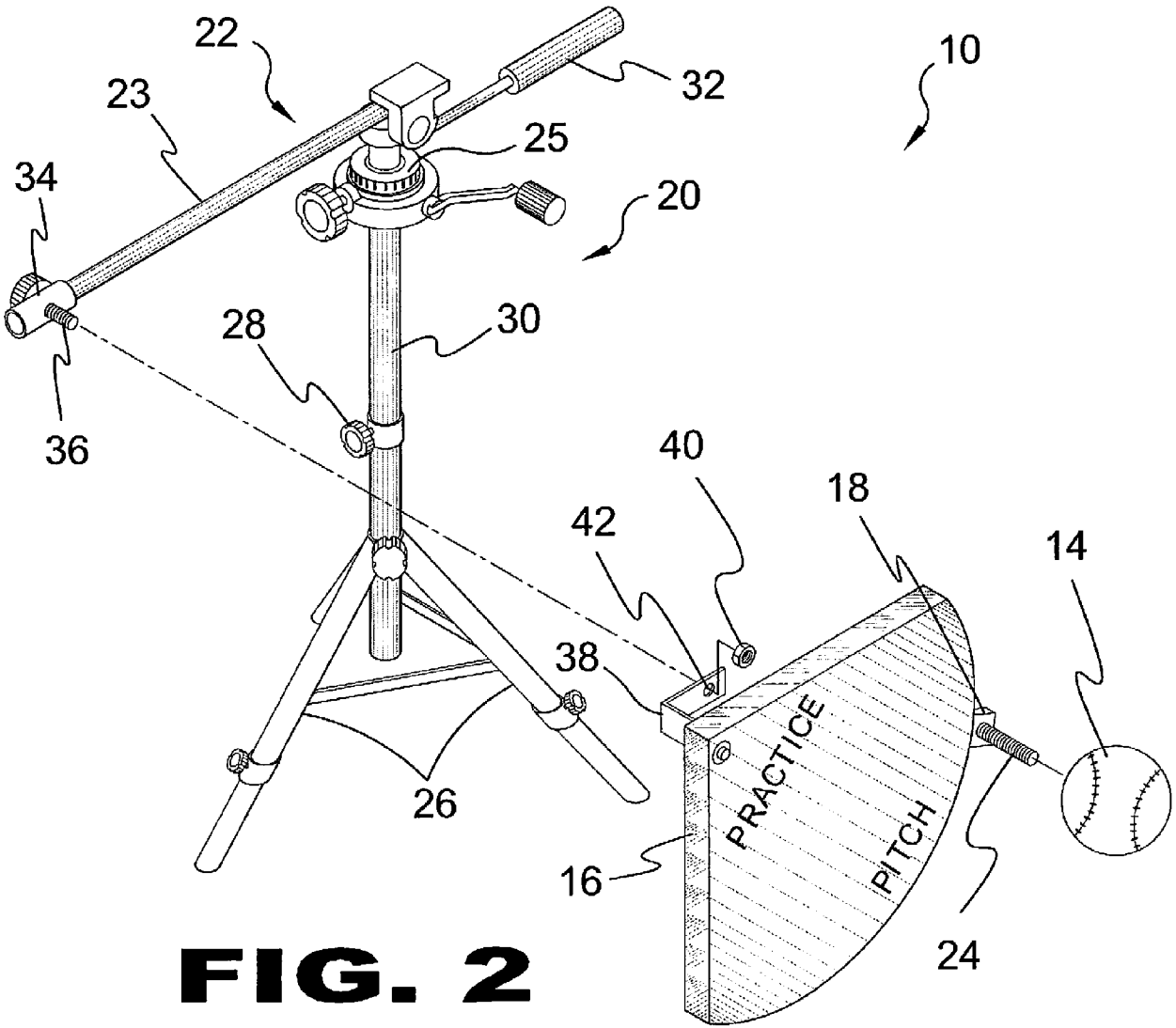
FIG. 2 is an exploded view of the present invention.

FIG. 2 is an exploded view of the present invention 10. The present invention consists of a tripod stand 20 measuring approximately three feet tall, having adjustable legs 26, a vertical main shaft 30 with height adjustment 28 and an adjustable boom arm assembly 22 at its top. The boom arm assembly 22 comprises a rotatable boom assembly mount 25 for mounting on said shaft 30, a boom arm 23, an adjustable boom arm angle tilt handle 32 and a guide wedge orientation adjustment 34 disposed on the distal end of the boom arm 23. The guide wedge 16 comprises a pair of spaced apart quarter circular plates connected on the straight sides thereby forming a hollow interior and an open channel on the curvilinear edge thereof. A pivoting bracket 18 travels within the interior of the wedge 16 and extends beyond the edge thereof where a short threaded post 20 to which a regulation sized softball 14 is perpendicularly attached. The side of the wedge 16 opposite the softball 14 features a short, right angled mounting bracket 38. The vertical portion of the bracket 18 has a mounting aperture 42 in its center and thus could be secured to the mounting post 36 on the boom 23 via a wing nut 40.

Figure 3:
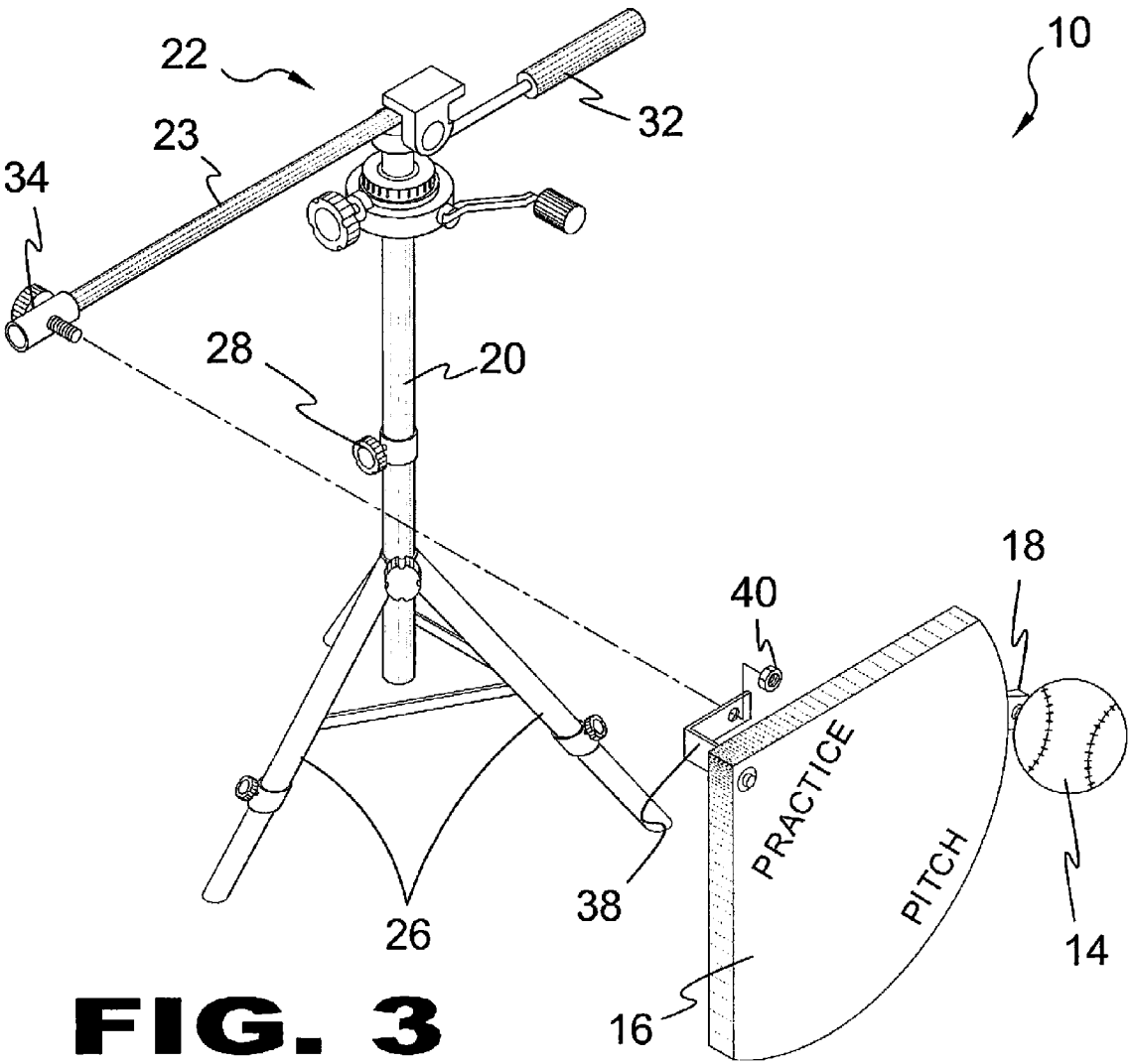
FIG. 3 is a partially exploded view of the present invention.

FIG. 3 is a partially exploded view of the present invention 10. To set up the device, the user simply erects the tripod 20 and boom assembly 22, positions the end of the boom 23 near the hip and secures the wedge 16 to the boom arm 23 with the mounting bracket 38 and nut 40 and the softball 14 to the pivoting bracket 18. The adjustable legs 26, tripod height adjustment 28 and boom arm angle tilt handle 32 are used to position the guide wedge 16 and the guide wedge orientation adjustment 34 is used to change the angle of the wedge 16 according to the type of pitch the user is working on.

Figure 4:
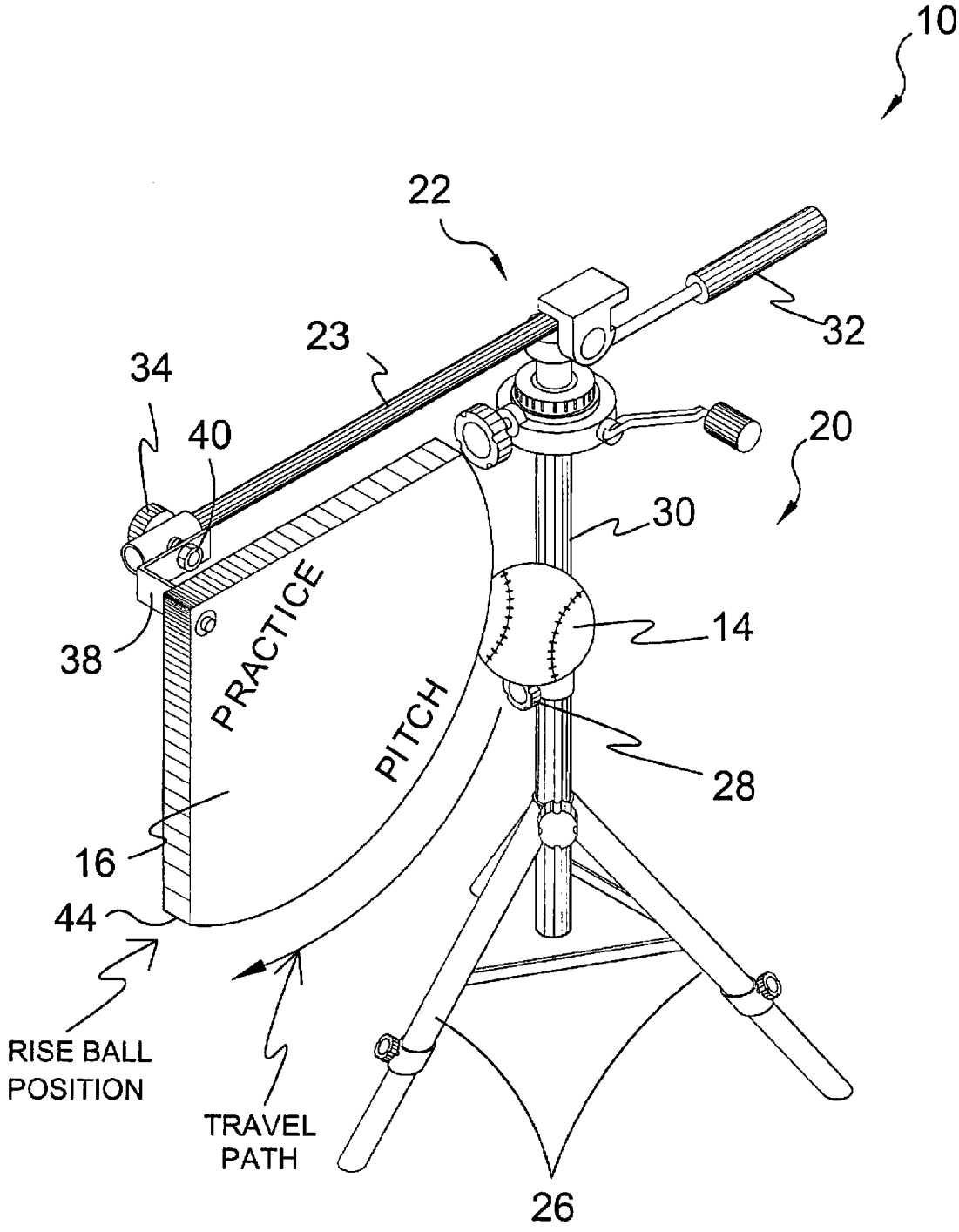
FIG. 4 is an assembled view of the present invention set up for rise ball practice.

FIG. 4 is an assembled view of the present invention 10 set up for rise ball practice. Shown is an assembled view of the present invention 10 consisting of a tripod stand 20 measuring approximately three feet tall, having adjustable legs 26, a vertical main shaft 30 with height adjustment 28 and an adjustable boom arm assembly 22 at its top. The boom arm assembly 22 comprises a boom arm 23, an adjustable boom arm angle tilt handle 32 and a guide wedge orientation adjustment 34 disposed on the distal end of the boom arm 23. The guide wedge 16 comprises a pair of spaced apart quarter circular plates connected on the straight sides thereby forming a hollow interior and an open channel on the curvilinear edge thereof. A pivoting bracket travels within the interior of the wedge 16 and extends beyond the edge thereof where a short threaded post 20 to which a regulation sized softball 14 is perpendicularly attached. The side of the wedge 16 opposite the softball 14 features a short, right angled mounting bracket 38. The vertical portion of the bracket 18 has a mounting aperture 42 in its center and thus could be secured to the mounting post 36 on the boom 23 via a wing nut 40. The pitcher simulates the arm movement of throwing a riser ball by moving the ball 14 along the guide track until stopping at the end of the wedge 16 which represents the release point 44 of where the ball 14 should be thrown to accomplish the desired results. Repetition of the movement promotes muscle memory of the proper release point 44.

Figure 5:
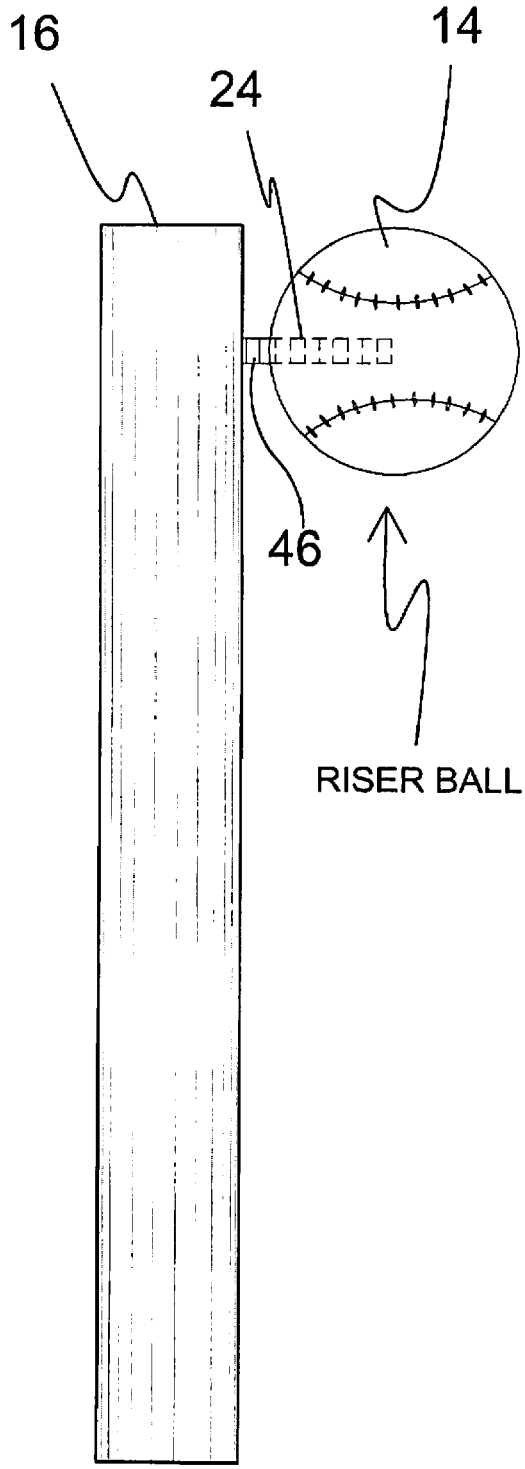
FIG. 5 is a side view of the present invention set up for rise ball practice.

FIG. 5 is a side view of the wedge 16 set up for rise ball practice. The softball 14 has a threaded aperture 46 that is used to screw the softball 14 onto the threaded post 24 of the pivoting bracket.

Figure 6:
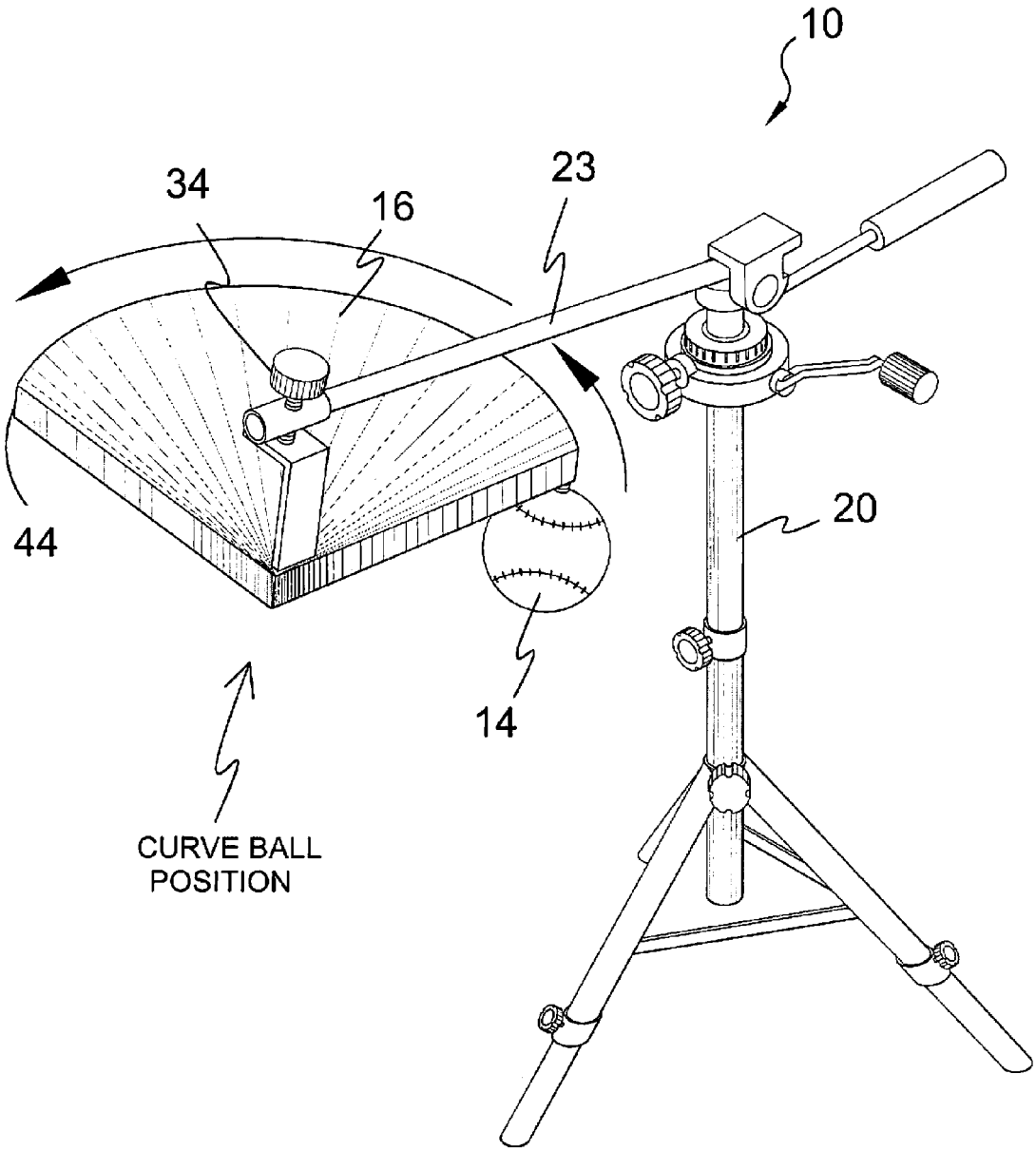
FIG. 6 is a perspective view of the present invention set up for curve ball practice.

FIG. 6 is a perspective view of the present invention 10 set up for curve ball practice. The wedge orientation adjustment 34 at the end of the boom arm 23 of the tripod 20 serves to change the angle and orientation of the wedge 16 to simulate the arm angle and release point of the ball 14. When the device 10 is assembled the user could grasp the ball and practice the roper gripping techniques used to execute different types of breaking pitches, such as the curve ball as shown in the illustration. The pivoting arm would also allow the pitcher to practice the proper release points 44 and flow through movements for such a pitch.

Figure 7:
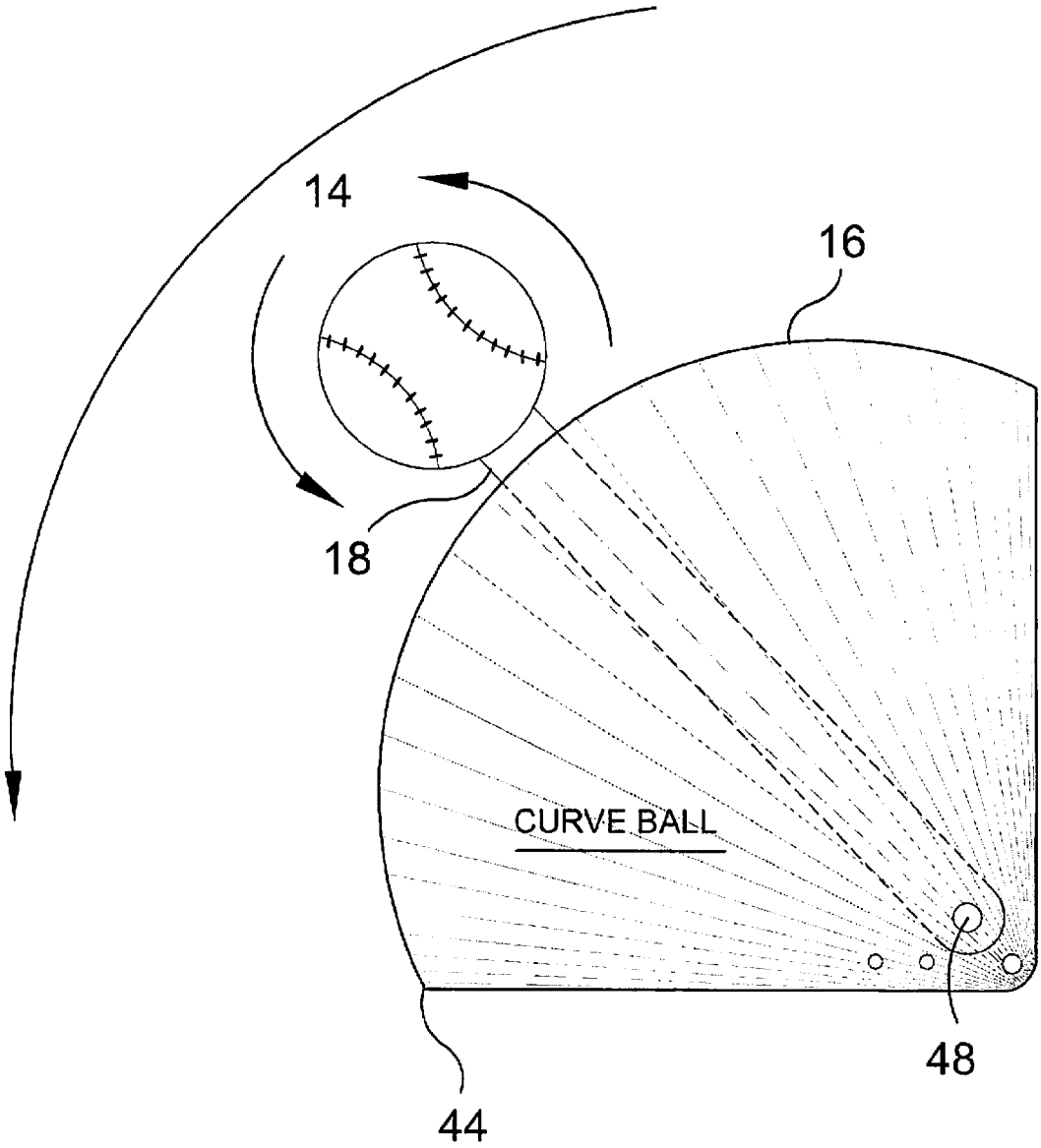
FIG. 7 is a perspective view of the present invention set up for curve ball practice.

FIG. 7 is a perspective view of the wedge 16 set up for curve ball practice. When the device is assembled the user could grasp the ball 14 and practice the roper gripping techniques used to execute different types of breaking pitches, such as the curve ball as shown in the illustration. The pivoting bracket 18 would also allow the pitcher to practice the proper release points 44 and flow through movements for such a pitch as the pivoting bracket 18 pivots on its attachment point 48 and travels through the wedge 16 with the edge of the wedge 16 representing the proper release point 44.

Figure 8:
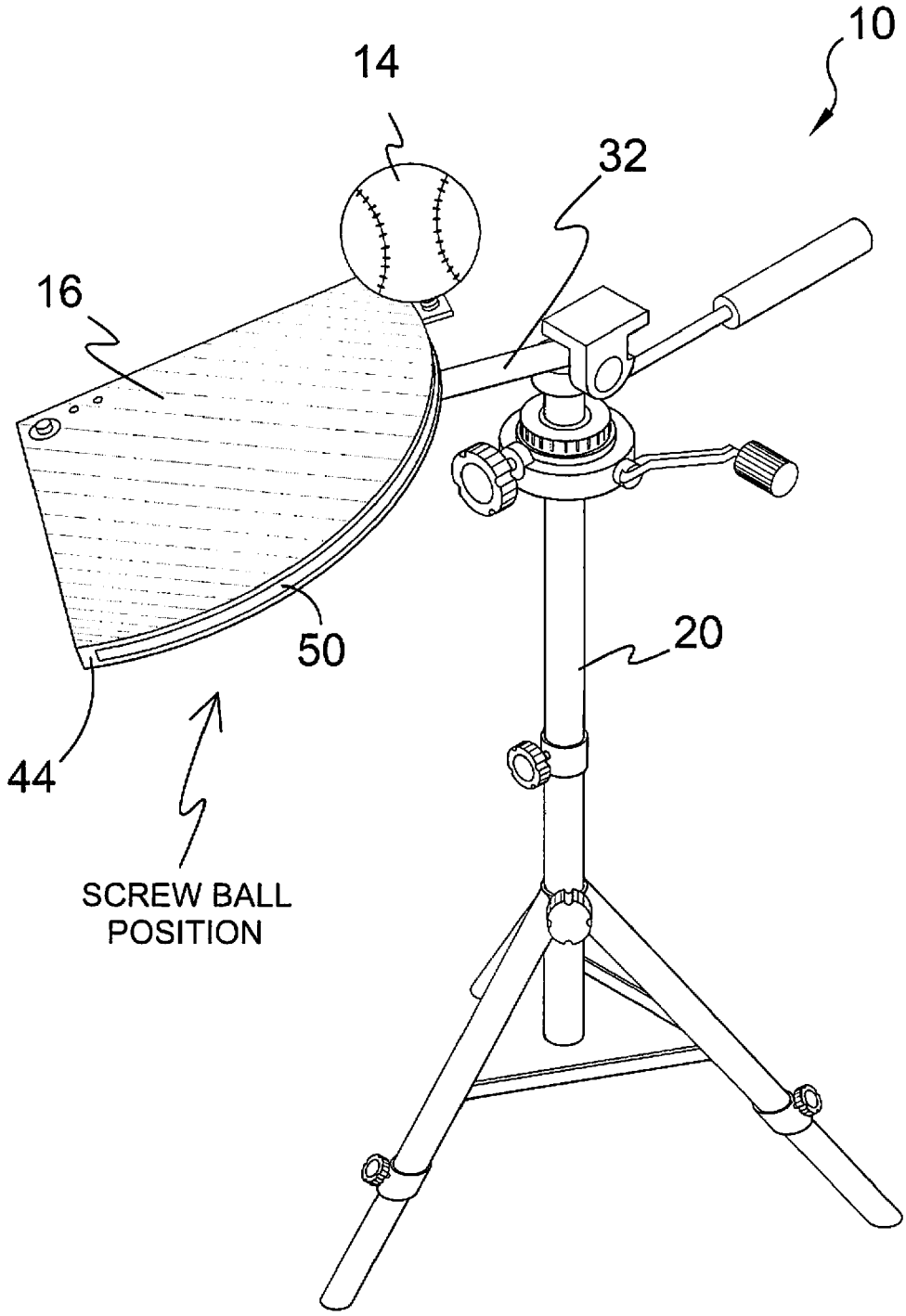
FIG. 8 is a perspective view of the present invention set up for screw ball practice.

FIG. 8 is a perspective view of the present invention 10 set up for screw ball practice. The wedge orientation adjustment at the end of the boom arm 23 of the tripod 20 serves to change the angle and orientation of the wedge 16 to simulate the arm angle and release point of the ball 14. When the device 10 is assembled the user grasps the ball and practices the roper gripping techniques used to execute different types of breaking pitches, such as the screwball as shown in the illustration. The pivoting bracket 18 also allows the pitcher to practice the proper release points 44 and flow through movements for such a pitch as the bracket 18 travels through the channel 50 which terminates at the release point 44.

Figure 9:
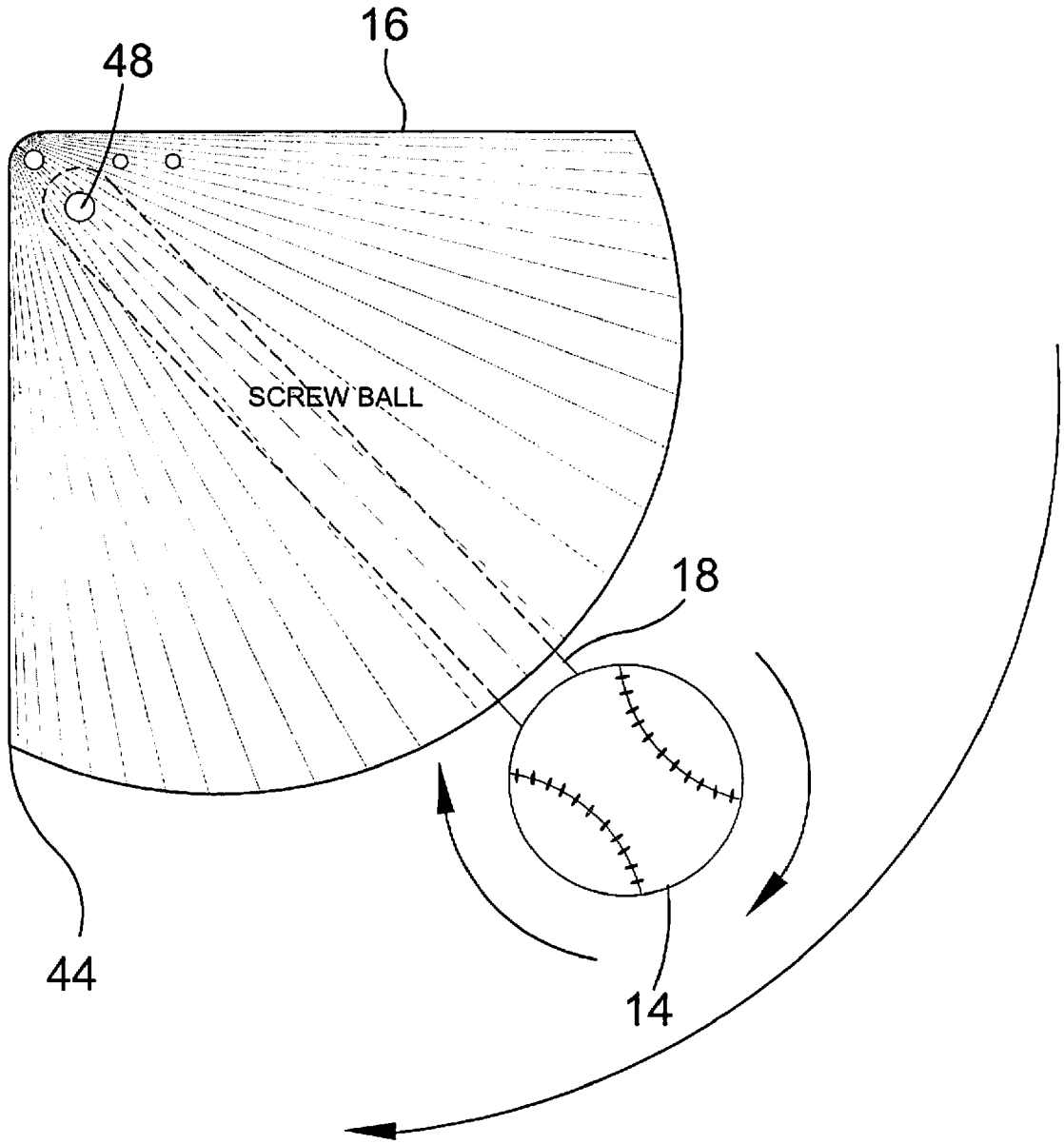
FIG. 9 is a planar view of the present invention set up for screw ball practice.

FIG. 9 is a planar view of the wedge 16 set up for screw ball practice. When the device is assembled the user could grasp the ball 14 and practice the roper gripping techniques used to execute different types of breaking pitches, such as the screw ball as shown in the illustration. The pivoting bracket 18 would also allow the pitcher to practice the proper release points 44 and flow through movements for such a pitch as the pivoting bracket 18 pivots on its attachment point 48 and travels through the wedge 16 with the edge of the wedge 16 representing the proper release point 44.

Figure 10:
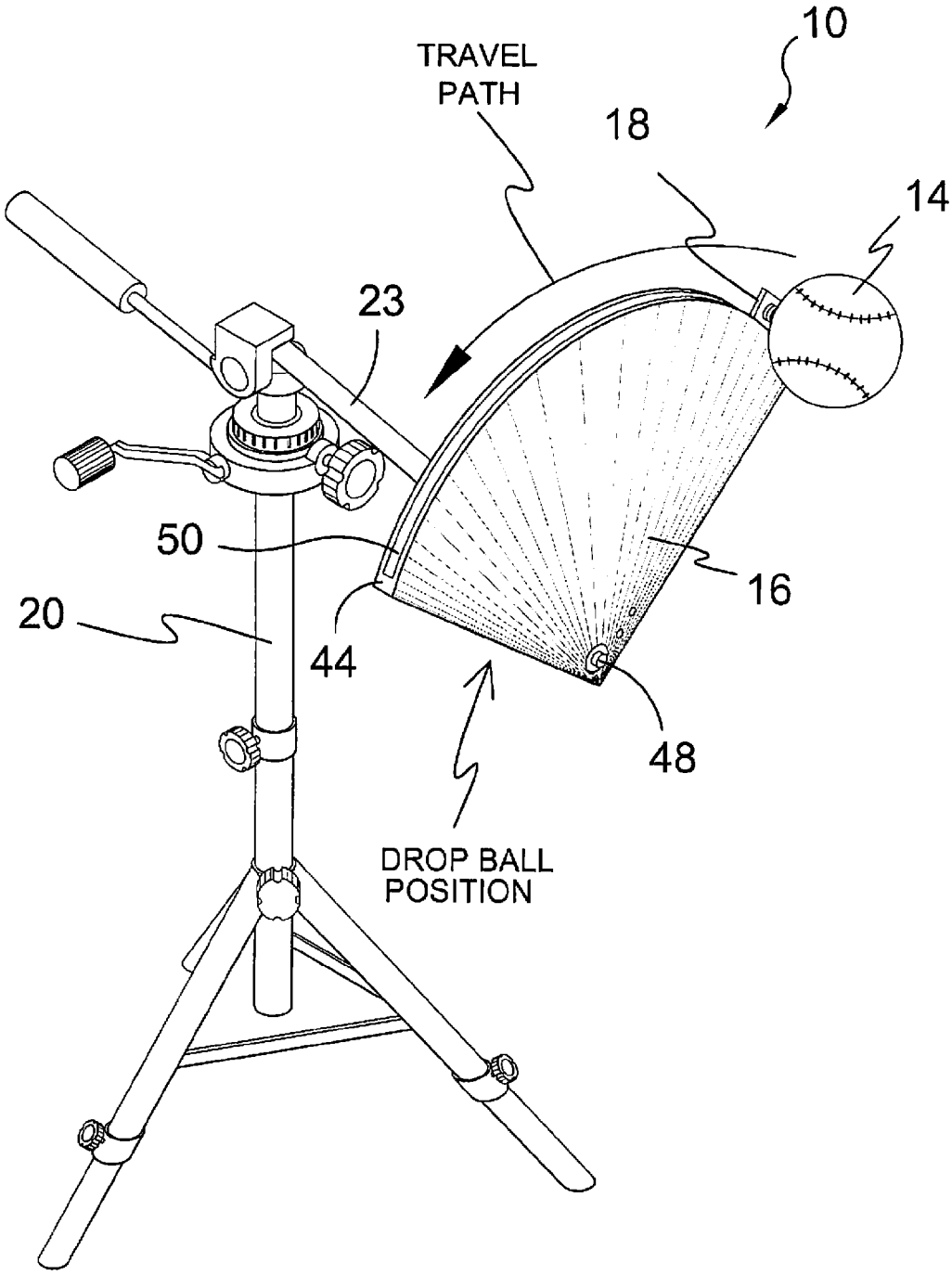
FIG. 10 is a perspective view of the present invention set up for drop ball practice.
Figure 11:
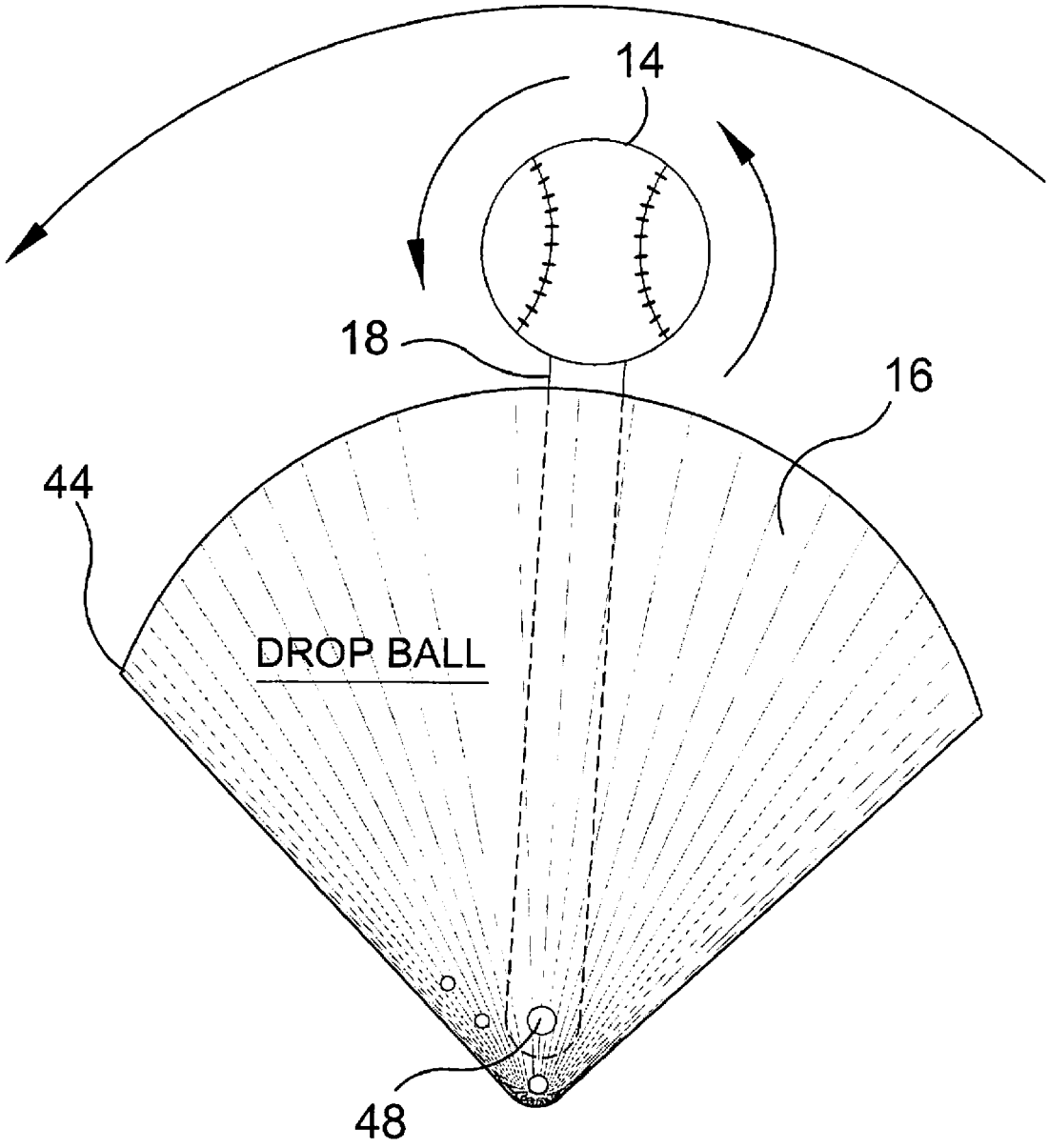
FIG. 11 is a perspective view of the present invention set up for drop ball practice.

FIG. 10 is a perspective view of the present invention 10 set up for drop ball practice. The wedge orientation adjustment at the end of the boom arm 23 of the tripod 20 serves to change the angle and orientation of the wedge 16 to simulate the arm angle and release point of the ball 14. When the device 10 is assembled the user grasps the ball and practices the roper gripping techniques used to execute different types of breaking pitches, such as the drop ball as shown in the illustration. The pivoting bracket 18 also allows the pitcher to practice the proper release points 44 and flow through movements for such a pitch as the bracket 18 pivots on its attachment point 48 and travels through the channel 50 which terminates at the release point 44.

FIG. 1 is a perspective view of the wedge 16 set up for drop ball practice. When the device is assembled the user could grasp the ball 14 and practice the roper gripping techniques used to execute different types of breaking pitches, such as the drop ball as shown in the illustration. The pivoting bracket 18 would also allow the pitcher to practice the proper release points 44 and flow through movements for such a pitch as the pivoting bracket 18 pivots on its attachment point 48 and travels through the wedge 16 with the edge of the wedge 16 representing the proper release point 44.

Figure 12:
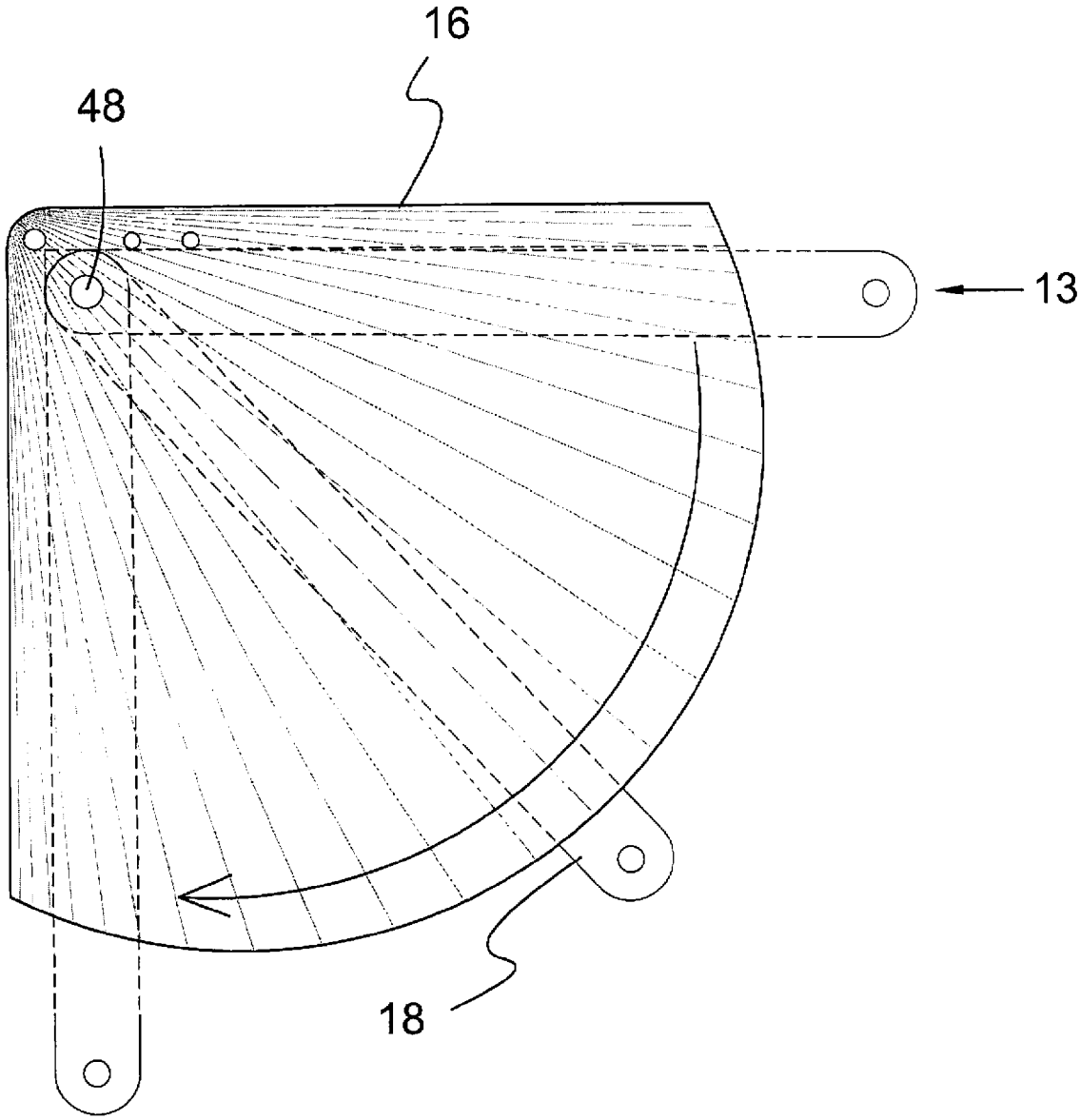
FIG. 12 is a planar view of the wedge of the present invention.

FIG. 12 is a planar view of the wedge 16 of the present invention. Demonstrated is the travel of the pivoting bracket 18 as it pivots on its attachment point 48 through the wedge 16.

Figure 13:
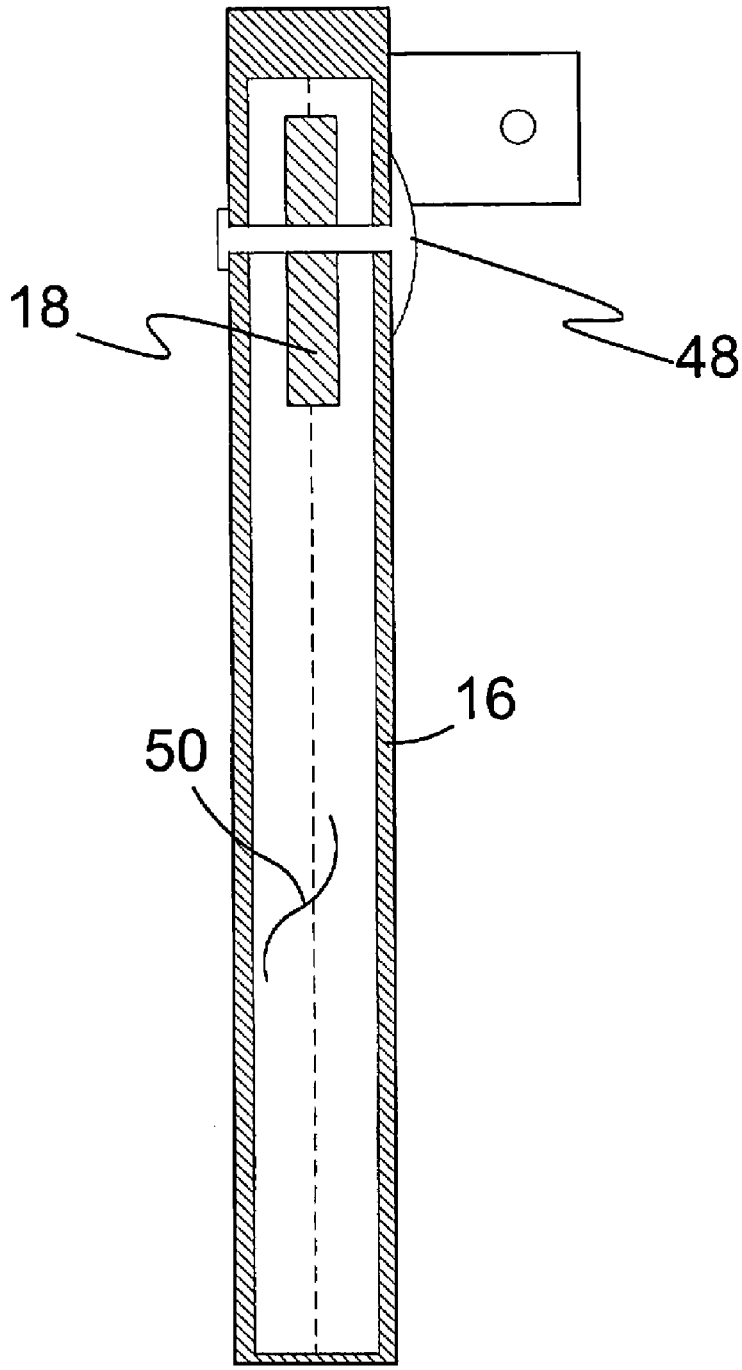
FIG. 13 is a side view of the present invention.

FIG. 13 is a side view of the wedge 16. The bracket 18 pivots on its attachment point 48 and travels through the channel 50 of the wedge 16.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A pitching practice device for establishing muscle memory in a pitcher regarding arm movement and proper release points for a plurality of types of pitches, said pitching practice device comprising:

a) a tripod;

b) a guide wedge comprising a pair of parallel, spaced apart quarter circular plates connected at the straight edges thereof forming an interior channel opening to the curvilinear edge thereof;

c) means for mounting said guide wedge to said tripod;

d) means for mounting a ball to travel along said curvilinear edge of said wedge when grasped and moved by said user; and e) means for adjusting the angle and orientation of said wedge to define the motion and release point according to the type of pitch to be practiced.

2. The pitching practice device recited in claim 1, wherein said wedge further includes an elongate bracket that is pivotally attached within said interior channel of said wedge.

3. The pitching practice device recited in claim 2, wherein said pivoting bracket has a first end with a pivotal attachment means proximal the point of convergence of said straight edges of said wedge and a second end extending beyond the periphery of said curvilinear edge.

4. The pitching practice device recited in claim 3, wherein said second end of said pivoting bracket includes a threaded post projecting perpendicularly therefrom.

5. The pitching practice device recited in claim 4, wherein said ball includes a threaded recess for receiving said threaded post and mounting thereon.

6. The pitching practice device recited in claim 5, wherein said wedge further includes a mounting bracket on the opposing side of said mounted ball for releasably mounting said wedge to said tripod.

7. The pitching practice device recited in claim 1, wherein said tripod includes a plurality of adjustment means for properly positioning said wedge at a proper height according to the height of the user.

8. The pitching practice device recited in claim 7, wherein said tripod further comprises a height adjustable main shaft supported by a three adjustable, foldable legs.

9. The pitching practice device recited in claim 8, wherein said tripod further includes a rotatable boom assembly mountable to the top of said main shaft.

10. The pitching practice device recited in claim 9, wherein said boom assembly comprises:

a) a rotatable boom assembly mount for mounting onto said tripod shaft;

b) a boom arm projecting from said boom assembly mount;

c) a boom arm angle tilt handle projecting from the opposing side of said boom assembly mount; and d) a guide wedge orientation adjustment and mount disposed on the distal end of said boom arm.

11. The pitching practice device recited in claim 10, wherein said boom arm angle tilt handle is used to position the angle of said boom arm and subsequently secure it in that position.

12. The pitching practice device recited in claim 10, wherein said guide wedge orientation adjustment includes threaded mounting post extending perpendicularly therefrom.

13. The pitching practice device recited in claim 12, wherein said wedge is mounted onto said boom by securing said threaded mounting post of said wedge orientation adjustment to said mounting bracket of said wedge.

14. The pitching practice device recited in claim 13, wherein said mounting bracket further includes a mounting aperture.

15. The pitching practice device recited in claim 14, wherein said threaded mounting post passes through said mounting aperture and is secured thereto by a wing nut.

16. The pitching practice device recited in claim 13, wherein said guide wedge orientation adjustment rotates around said boom to change and secure the orientation of said wedge channel to a specified plane depending on the type of pitch to be practiced.

17. The pitching practice device recited in claim 16, wherein said wedge is pivotable on said mounting post and is securable at a specific angle depending on the type of pitch to be practiced.

18. The pitching practice device recited in claim 17, wherein the user places the wedge at the appropriate height, angle and orientation for the pitch to be practiced.

19. The pitching practice device recited in claim 18, wherein the user grasps said ball and moves it along said curvilinear edge of said wedge to simulate the motion for throwing the pitch being practiced.

20. The pitching practice device recited in claim 19, wherein said user moves said ball along said curvilinear edge until said pivoting bracket reaches the end of said wedge channel which represents the point of release of the pitch being practiced.

21. The pitching practice device recited in claim 20, wherein the user continues to repeat moving the ball along said curvilinear edge to the point of release to reinforce muscle memory to be able to respond accordingly during actual pitching conditions.

22. The pitching practice device recited in claim 1, wherein said ball is a regulation sized softball.

* * * * *